United States Patent [19]

Lehner

[11] Patent Number: 4,764,705

[45] Date of Patent: Aug. 16, 1988

[54] PICTURE TUBE WITH DEFLECTION YOKE

[75] Inventor: Heinz Lehner, Oberschneiding, Fed. Rep. of Germany

[73] Assignee: Standard Elektrik Lorenz, A.G., Fed. Rep. of Germany

[21] Appl. No.: 65,354

[22] Filed: Jun. 22, 1987

[30] Foreign Application Priority Data

Jun. 26, 1986 [DE] Fed. Rep. of Germany ..... 3621373

[51] Int. Cl.[4] ..... H01J 29/70

[52] U.S. Cl. ..... 313/440; 335/213

[58] Field of Search ..... 313/440; 358/248, 249; 335/213

[56] References Cited

U.S. PATENT DOCUMENTS 2,852,712 9/1958 Fabel ..... 335/213 X 4,620,127 10/1986 Chung et al. ..... 313/440

FOREIGN PATENT DOCUMENTS 53-35314 4/1978 Japan ..... 358/248

*Primary Examiner*—David K. Moore

*Assistant Examiner*—Sandra L. O'Shea

*Attorney, Agent, or Firm*—Peter C. Van Der Sluys

[57] ABSTRACT

A deflection yoke is mounted on a picture tube in such a manner that a ring of thermoplastic material is first attached by adhesive bonding to the tube neck and the deflection yoke is then pushed onto the picture tube, so that a tubular extension to the coil form of the deflection yoke overlies the ring. The tubular extension is of the same thermoplastic material as the ring. When the deftlection yoke has been adjusted, the thermoplastic ring and the tubular extension are joined together by a welding operation, e.g., by spot welding. The result is a rapidly setting and operationally stable joint between the deflection yoke and the picture tube. To improve adjustability, the ring can have a curved surface.

18 Claims, 1 Drawing Sheet

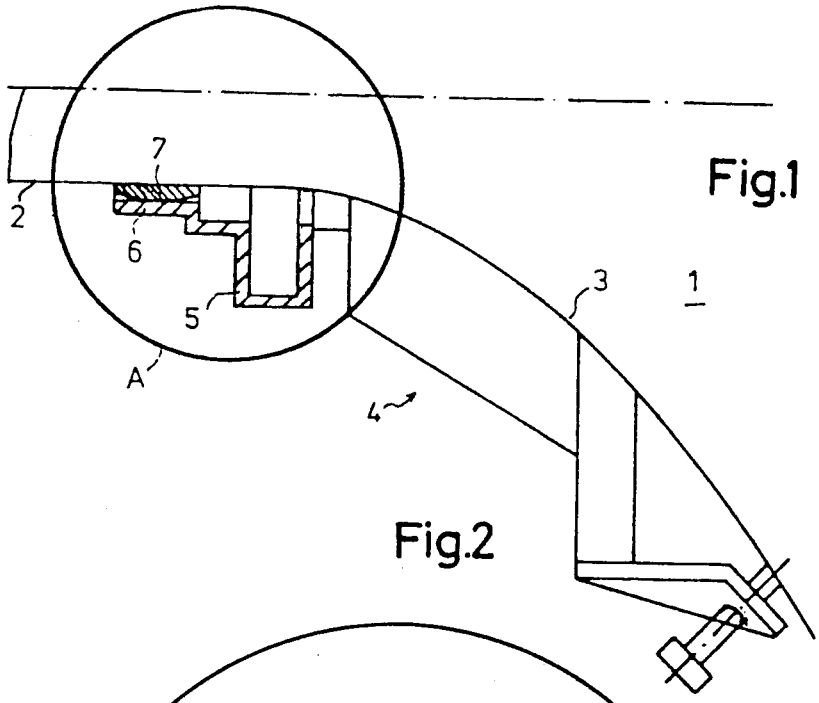
Fig.1
Fig.2
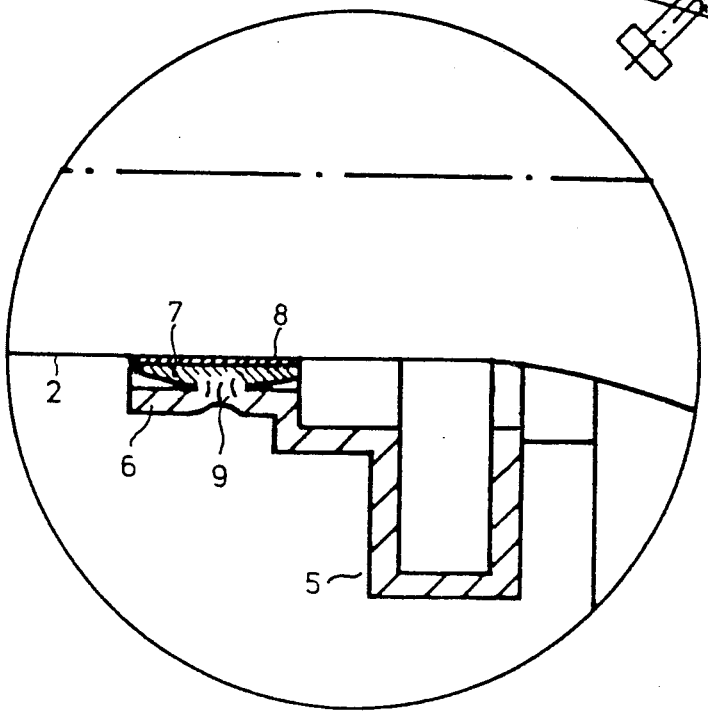

PICTURE TUBE WITH DEFLECTION YOKE

BACKGROUND OF THE INVENTION

1. Field of the Invention

The present invention relates to a picture tube with a deflection yoke mounted thereon and more particularly to apparatus for mounting said deflection yoke.

2. Description of the Prior Art

The deflection yoke for a picture tube is mounted on the tube neck and rests against the funnel of the picture tube. After the deflection yoke is mounted on the picture tube, it must be adjusted precisely in relation to the latter, so that a perfect picture is obtained. Subsequently, the deflection yoke must be attached to the picture tube so that it can no longer shift. When the deflection yoke is mounted on the picture tube, the temperature and the pressure on the picture tube must not be too high, because this can result in damage to the picture tube.

As disclosed, for example, in DE-OS No. 24 08 673, the deflection yoke can be mounted on the picture tube either mechanically or by adhesive bonding. Thus, the deflection yoke can, for example, be fastened to the picture tube by a clamp which can be tightened by means of a screw. If the screw is loosened, the deflection yoke can be moved on the tube neck, and can be fixed after adjustment by tightening the screw. However, the pressure exerted must not be too high so as to avoid cracking of the tube neck.

If the deflection yoke is fixed to the tube neck by adhesive bonding, a suitable adhesive has to be introduced between the deflection yoke and the picture tube. This is difficult and often requires special channels to introduce the adhesive. A cold-setting adhesive has the advantage that the temperature effect on the picture tube is small; the disadvantage is, however, that on the one hand, the adjusting operation must be completed before the adhesive sets, while on the other hand, the deflection yoke must be held in position until the adhesive sets.

If an adhesive is used which softens with the application of heat, the softening temperature must not be too high, so that an unfavorable impact on the picture tube is avoided during initial application. On the other hand, th picture tube must not be heated during operation to the softening temperature or the deflection yoke may shift.

Since evidently the deflection yoke cannot be mounted satisfactorily on the picture tube by any of the above means, DE-OS No. 24 08 673 proposes to provide the funnel of the picture tube with ribs or rough spots to prevent the adjusted deflection yoke from being shifted. However, this requires that the body of the picture tube be designed or treated in a special manner.

In accordance with DE-AS No. 23 42 052, individual strips of thermoplastic material joining the deflection yoke and the picture tube are to be cemented in the longitudinal direction between the two parts. To this end, a hot-setting adhesive having a melting temperature of about 150° C. is used. When the hot-setting adhesive is introduced, the picture tube must be kept at a temperature of 50° C. Furthermore, the deflection yoke must have suitable channels into which the hot-setting adhesive can be introduced.

It is known from DE-OS No. 24 51 288 to mount a deflection yoke on a picture tube by first attaching a ring with four hollow pins to the funnel of the picture tube by means of an adhesive. On its circumference, the deflection yoke has lugs pointing radially outwardly which are inserted into outwardly projecting recesses of a second plastic ring. Both parts together are then placed on the pins of the first ring and are joined together by introducing an adhesive. In this embodiment, several parts of complex shapes are required which must be joined together.

SUMMARY OF THE INVENTION

It is an object of the invention to mount a deflection yoke on a picture tube quickly and safely with only a few simple parts.

In accordance with the invention, a ring of thermoplastic material is first attached to the tube neck. The ring can be attached, for example, by means of a double-sided adhesive tape. A cold-setting adhesive can also be used, since the ring is attached independently of the adjustment of the deflection yoke.

The deflection yoke itself has a tubular extension which is integrally molded to its coil form and which is made of the same thermoplastic material as the ring attached to the tube neck. The thermoplastic material is preferably amorphous or partly crystalline. The deflection yoke is then pushed over the tube neck until the tubular extension lies on top of the ring which is attached to the tube neck. The deflection yoke can now be moved in an adjustment fixture in the longitudinal direction and can also be rotated until it has taken its optimum position. Using a short welding operation, preferably by spot welding, the ring attached to the tube neck is welded to the tubular extension of the coil form of the deflection yoke, the deflection yoke thus being fixed in position immediately in relation to the picture tube.

DESCRIPTION OF THE DRAWINGS

FIG. 1 is a schematic partial section of portions of the neck and funnel of a picture tube and the deflection yoke mounted thereon.

FIG. 2 is an enlarged representation of the parts shown in the circle A of FIG. 1 to illustrate the details.

DETAILED DESCRIPTION OF THE INVENTION

FIG. 1 shows only parts of the tube neck 2 and the funnel 3 of the picture tube 1. The deflection yoke 4 is located partly on the tube neck 2 and rests partly against the funnel 3. The coil form 5 of the deflection yoke 4 has a tubular extension 6 of thermoplastic material, preferably an amorphous or partly crystalline thermoplastic material. Below the extension, a ring 7 made of the same thermoplastic material as the extension 6 is attached to the tube neck 2, preferably by adhesive bonding.

First, the ring 7 of thermoplastic material is attached by adhesive bonding to the tube neck 2. To this end, a cold-setting adhesive can be used, for example, or a double-sided adhesive tape. The deflection yoke 4 is then pushed onto the picture tube so that the tubular extension 6 of the coil form 5 of the deflection yoke 4 lies on the ring 7. Next, the deflection yoke 4 is moved in a suitable adjustment fixture in the longitudinal direction or rotated about its axis in relation to the picture tube until its optimum position is reached. Then, the extension 6 is joined with the ring 7 by a short welding operation, so that the deflection yoke 4 is now fixed in position in relation to the picture tube 1. For tolerance compensation, the tubular extension 6 may be slotted in the direction of its axis.

FIG. 2, which is an enlarged illustration of the parts shown in the circle A of FIG. 1, additionally shows the adhesive layer 8 by which the ring 7 is attached to the tube neck 2, and a weld spot 9 by which the extension 6 and the ring 7 are joined together.

The thermoplastic material of which the tubular extension 6 and the ring 7 are made can have a relatively high melting point because only short-term heating, which does not impair the picture tube, is required to weld the two parts. Welding at the spot 9 of FIG. 2 can, for example, be carried out by pressing a heated stamp into several spots along the circumference.

In order to permit adjustment of the deflection yoke by tilting in relation to the axis of the picture tube, the ring 7 preferably has a surface curved in the direction of the tube axis or the tube neck. This is shown particularly clearly in FIG. 2.

As can be seen from the drawings, the invention requires only a few simple parts for mounting the deflection yoke on the picture tube. For adjustment, the deflection yoke can be moved in all directions, and when the two parts of thermoplastic material have been welded, the picture tube and the deflection yoke can be removed immediately from the adjustment fixture since the thermoplastic material solidifies rapidly as a result of its high melting point. Nevertheless, there is no high thermal impact on the picture tube since only short-term, local heating is required and welding is carried out at the surface of the ring 7 which does not face the picture tube.

As a result of the relatively high melting point of the thermoplastic material, it is unlikely that the deflection yoke will be shifted due to heating during the operation of the picture tube.

What is claimed is:

1. An assembly, comprising:

a picture tube having a neck;

a deflection yoke, having a coil form, disposed about the neck of the picture tube;

a ring of thermoplastic material attached to the tube neck; and a tubular extension of thermoplastic material formed on said deflection yoke and being permanently joined to said ring, whereby the deflection yoke may be fixedly positioned relative to the tube at an optimum position.

2. An assembly as claimed in claim 1, wherein the ring and tubular extension are formed of the same thermoplastic material.

3. An assembly as claimed in claim 1, wherein the tubular extension is formed at the coil form and is attached thereto.

4. An assembly as claimed in claim 1, wherein the ring is attached to the tube neck by an adhesive.

5. An assembly as claimed in claim 1, wherein the ring is attached to the tube neck by a double-sided adhesive tape.

6. An assembly as claimed in claim 1, wherein the ring has a curved surface, thereby facilitating adjustment of the deflection yoke.

7. An assembly as claimed in claim 1, wherein the ring and the tubular extension are joined together by spot welding.

8. An assembly as claimed in claim 7, wherein the tubular extension is slotted in the direction of its axis.

9. An assembly as claimed in claim 6, wherein the tubular extension is slotted in the direction of its axis.

10. An assembly as claimed in claim 5, wherein the tubular extension is slotted in the direction of its axis.

11. An assembly as claimed in claim 4, wherein the tubular extension is slotted in the direction of its axis.

12. An assembly as claimed in claim 3, wherein the tubular extension is slotted in the direction of its axis.

13. An assembly as claimed in claim 2, wherein the tubular extension is slotted in the direction of its axis.

14. An assembly as claimed in claim 1, wherein the tubular extension is slotted in the direction of its axis.

15. An assembly as claimed in claim 2, wherein the ring is attached to the tube neck by an adhesive.

16. An assembly as claimed in claim 3, wherein the ring is attached to the tube neck by an adhesive.

17. An assembly as claimed in claim 2, wherein the ring is attached to the tube neck by a double-sided adhesive tape.

18. An assembly as claimed in claim 3, wherein the ring is attached to the tube neck by a double-sided adhesive tape.

* * * * *